US011185200B2

(12) United States Patent
Hong et al.

(10) Patent No.: US 11,185,200 B2
(45) **Date of Patent: *Nov. 30, 2021**

(54) ROBOT CLEANER

(71) Applicant: SAMSUNG ELECTRONICS CO., LTD., Suwon-si (KR)

(72) Inventors: Seok Man Hong, Gwangju (KR); Sung Jin Park, Suwon-si (KR); Young Jae Park, Suwon-si (KR); Jin Wook Yoon, Yongin-si (KR); Dong Woo Ha, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 253 days.

This patent is subject to a terminal disclaimer.

(21) Appl. No.: 16/157,881

(22) Filed: Oct. 11, 2018

(65) Prior Publication Data

US 2019/0075986 A1 Mar. 14, 2019

Related U.S. Application Data

(63) Continuation of application No. 15/501,668, filed as application No. PCT/KR2015/004237 on Apr. 28, 2015, now Pat. No. 10,561,288.

(30) Foreign Application Priority Data

Aug. 7, 2014 (KR) ..... 10-2014-0101733

(51) Int. Cl.

| | |
|---|---|
| ***A47L 9/04*** | (2006.01) |
| ***A47L 9/02*** | (2006.01) |
| ***A47L 9/24*** | (2006.01) |

(52) U.S. Cl.

CPC ..... *A47L 9/0477* (2013.01); *A47L 9/02* (2013.01); *A47L 9/24* (2013.01); *A47L 2201/00* (2013.01); *A47L 2201/04* (2013.01)

(58) Field of Classification Search

None

See application file for complete search history.

(56) References Cited

U.S. PATENT DOCUMENTS 5,199,996 A * 4/1993 Jonas ..... A47L 9/24 134/18
6,514,356 B2 * 2/2003 Vystrcil ..... A47L 5/28 134/21

(Continued)

FOREIGN PATENT DOCUMENTS

DE 10 2012 109 970 A1 5/2014
GB 2 432 301 A 5/2007

(Continued)

OTHER PUBLICATIONS

Extended European Search Report dated May 3, 2018, in corresponding European Patent Application No. 15829186.4.

(Continued)

*Primary Examiner* — Brian D Keller
(74) *Attorney, Agent, or Firm* — Staas & Halsey, LLP

(57) ABSTRACT

A robot cleaner including: a main body, a driving unit configured to move the main body, and a suction device provided in the main body and configured to suction outside foreign substances, and the suction device may include a first suction member having a suction port provided at a bottom surface of the main body and configured to suction the foreign substances, and at least one second suction member formed to move relative to the first suction member and having a suction port configured to suction the foreign substances.

9 Claims, 17 Drawing Sheets

(56) References Cited

U.S. PATENT DOCUMENTS

| | | | |
|---|---|---|---|
| 7,673,367 | B2 | 3/2010 | Kim et al. |
| 8,869,342 | B2 | 10/2014 | Yoon et al. |
| 2007/0113373 | A1 | 5/2007 | Hato et al. |
| 2008/0141485 | A1 | 6/2008 | Kim et al. |

FOREIGN PATENT DOCUMENTS

| | | |
|---|---|---|
| JP | 2006-34813 | 2/2006 |
| KR | 2003-0085804 | 11/2003 |
| KR | 10-2004-0103256 | 12/2004 |
| KR | 10-0783155 | 12/2007 |
| KR | 10-2009-0057160 | 6/2009 |
| KR | 10-2014-0082219 | 7/2014 |
| KR | 10-2014-0103256 | 8/2014 |

OTHER PUBLICATIONS

Australian Office Action dated Mar. 20, 2018, in corresponding Australian Patent Application No. 2015299947.
European Office Action dated Mar. 14, 2017, in corresponding European Patent Application No. 15829186.4.
Australian Office Action dated Oct. 13, 2017, in corresponding Australian Patent Application No. 2015299947.
International Search Report dated Aug. 3, 2015 in corresponding International Application No. PCT/KR2015/004237.
Australian Notice of acceptance for patent application dated Jul. 24, 2018, in corresponding Australian Patent Application No. 2015299947.
Office Action dated Aug. 9, 2018 in U.S. Appl. No. 15/501,668.
U.S. Appl. No. 15/501,668, filed Feb. 3, 2017, Seok Man Hong et al.
Israeli Office Action dated Jul. 13, 2020, in corresponding Israeli Patent Application No. 250,399.
Chinese Office Action dated Nov. 14, 2018, in Chinese Patent Application No. 201580054664.9.
Chinese Patent Office Action issued in Chinese Patent Application No. 201580054664.9 dated Sep. 4, 2019.
European Office Action dated Feb. 1, 2019, in European Patent Application No. 15 829 186.4.
Chinese Office Action dated Jun. 6, 2019 in corresponding Chinese Patent Application No. 201580054664.9.
Advisory Action dated Aug. 29, 2019 in related U.S. Appl. No. 15/501,668.
Office Action dated Dec. 26, 2018 in U.S. Appl. No. 15/501,668.
Final Office Action dated Jun. 26, 2019 in co-pending U.S. Appl. No. 15/501,668.
Notice of Allowance dated Oct. 10, 2019 in co-pending U.S. Appl. No. 15/501,668.
Korean Office Action dated Oct. 19, 2020, in corresponding Korean Patent Application No. 10-2014-0101733.
Korean Office Action dated Apr. 30, 2021, in corresponding Korean Patent Application No. 10-2014-0101733.
Korean Office Action dated Jun. 24, 2021, in corresponding Korean Patent Application No. 10-2014-0101733.

* cited by examiner

[Fig. 1]
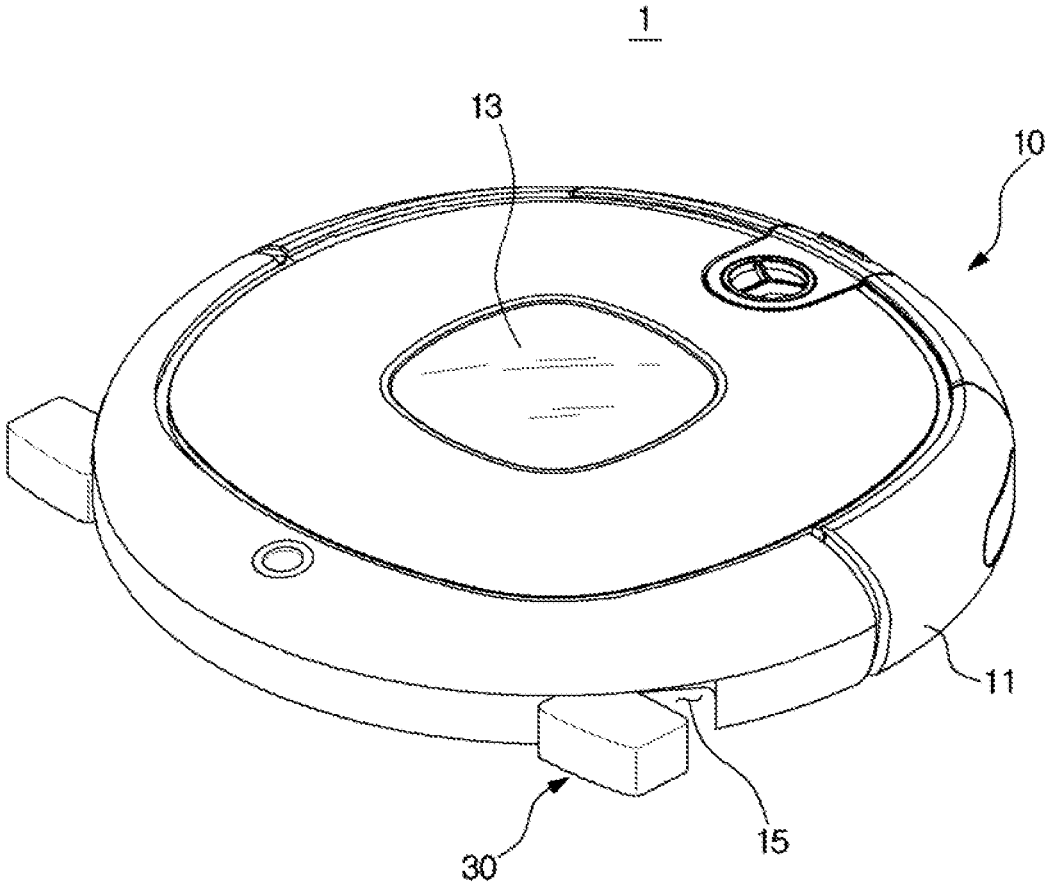

[Fig. 2]
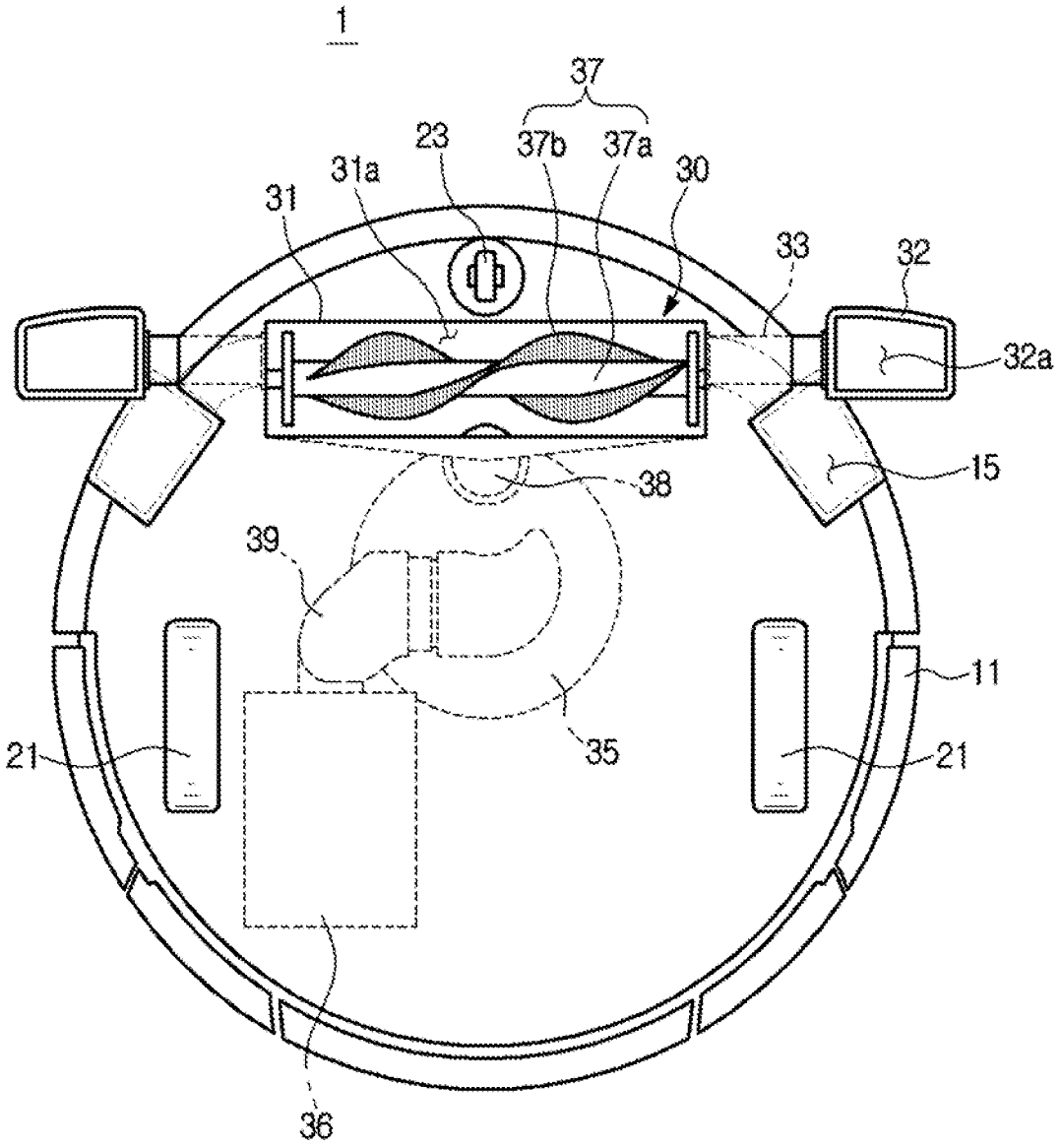

[Fig. 3]
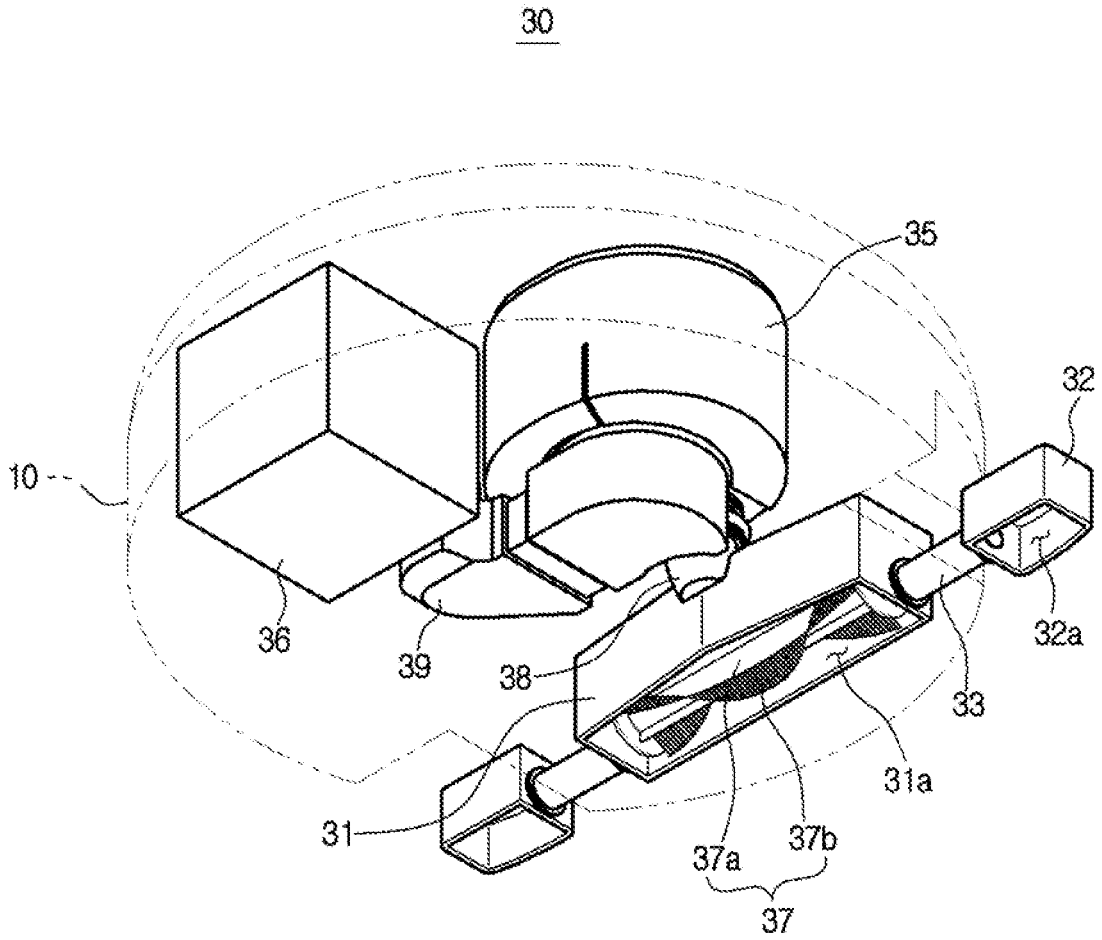

[Fig. 4]
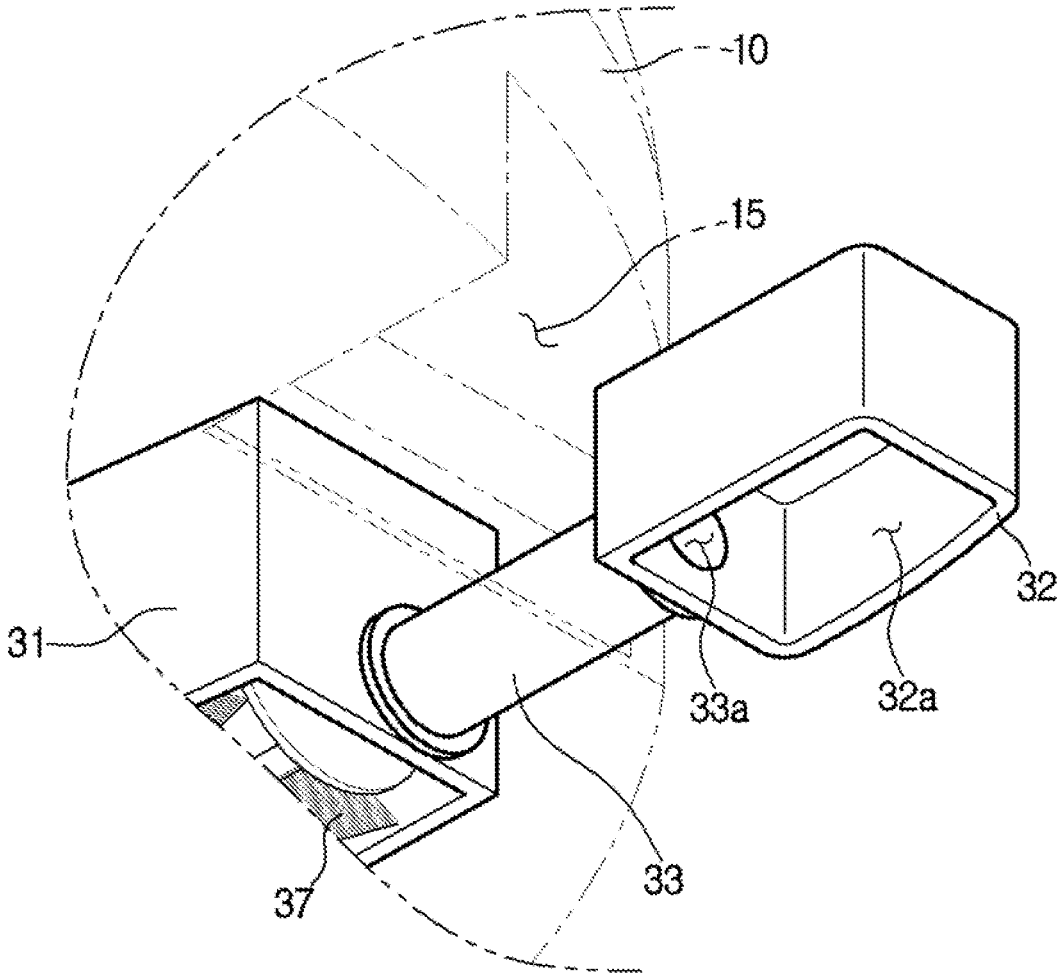

[Fig. 5]
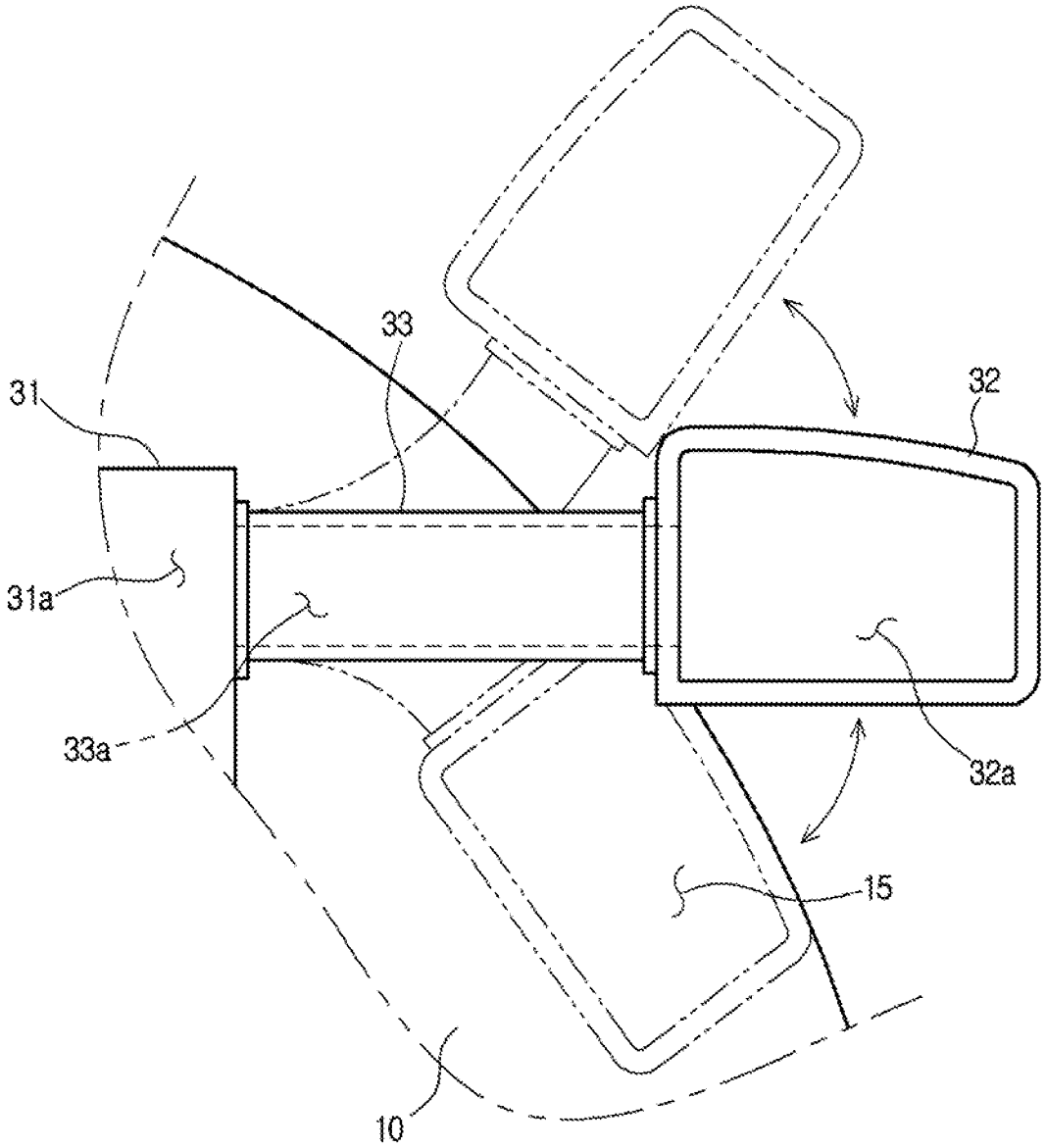

[Fig. 6]
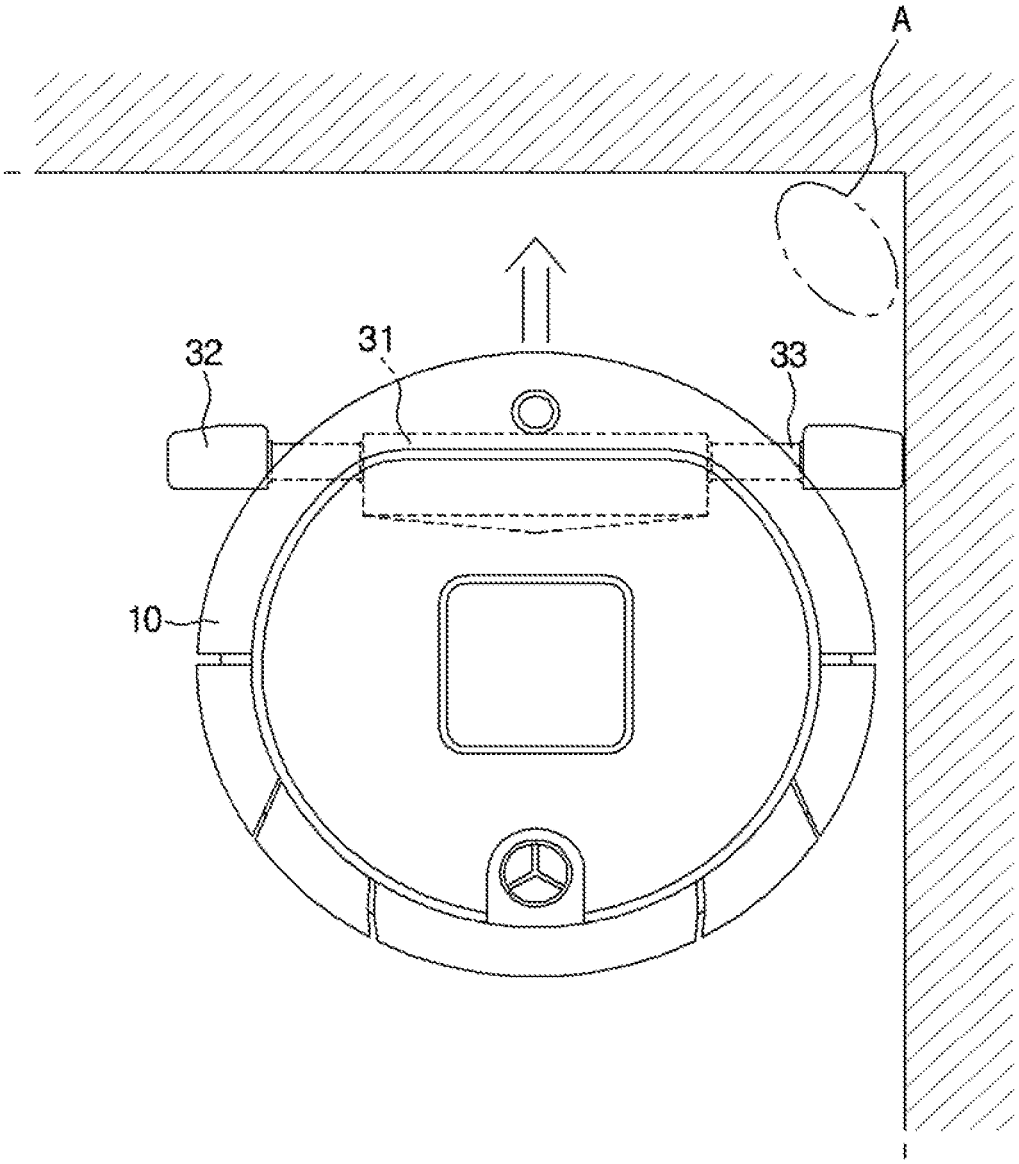

[Fig. 7]
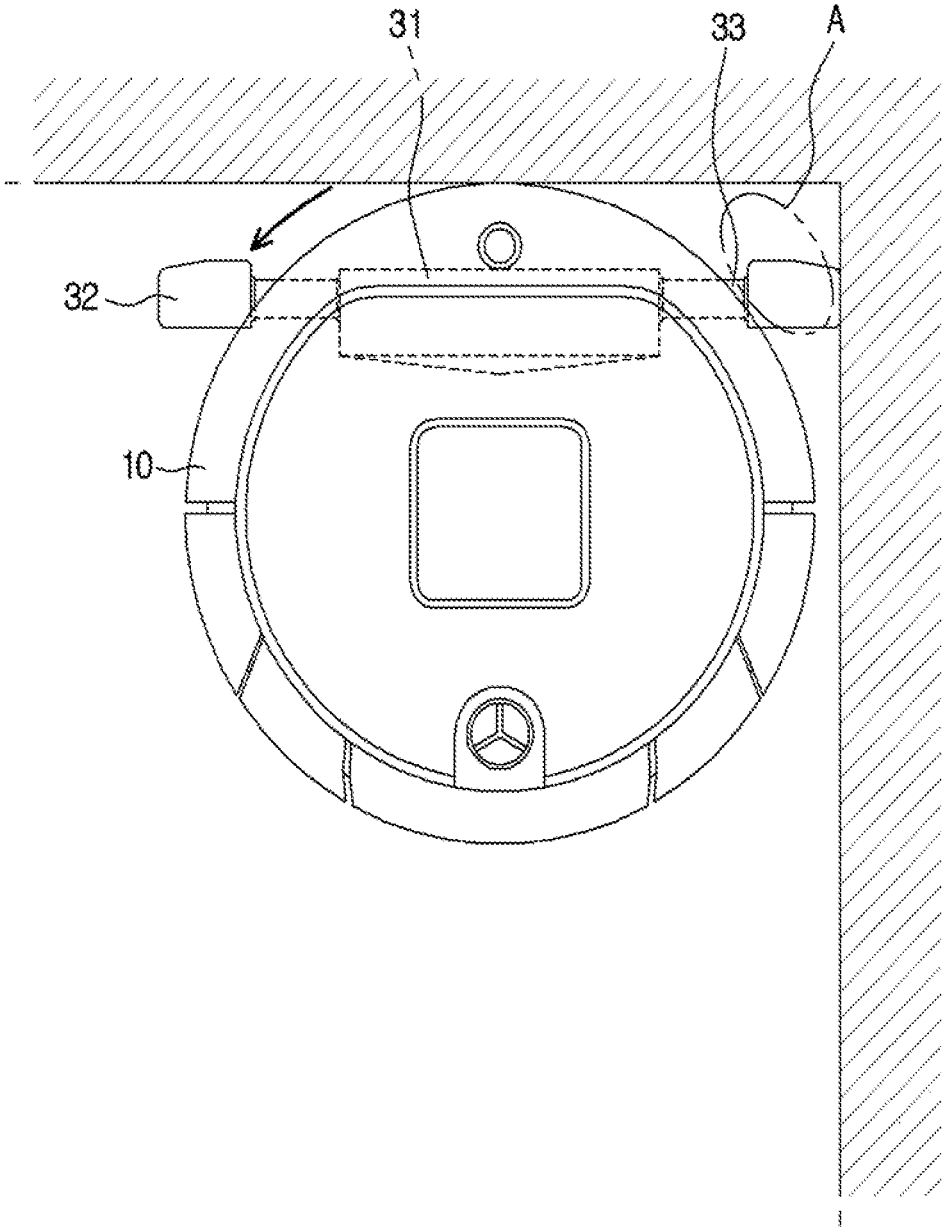

[Fig. 8]
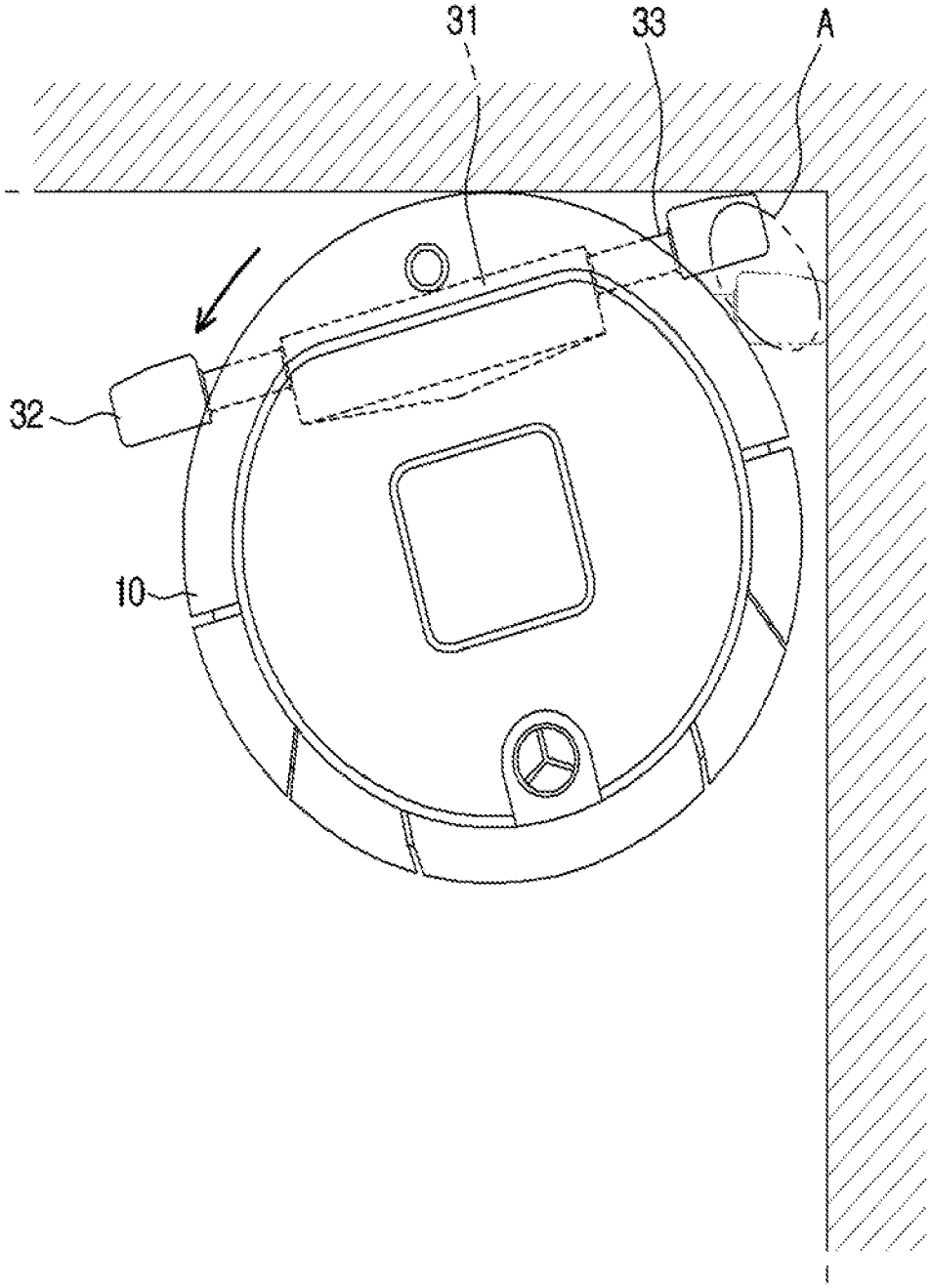

[Fig. 9]
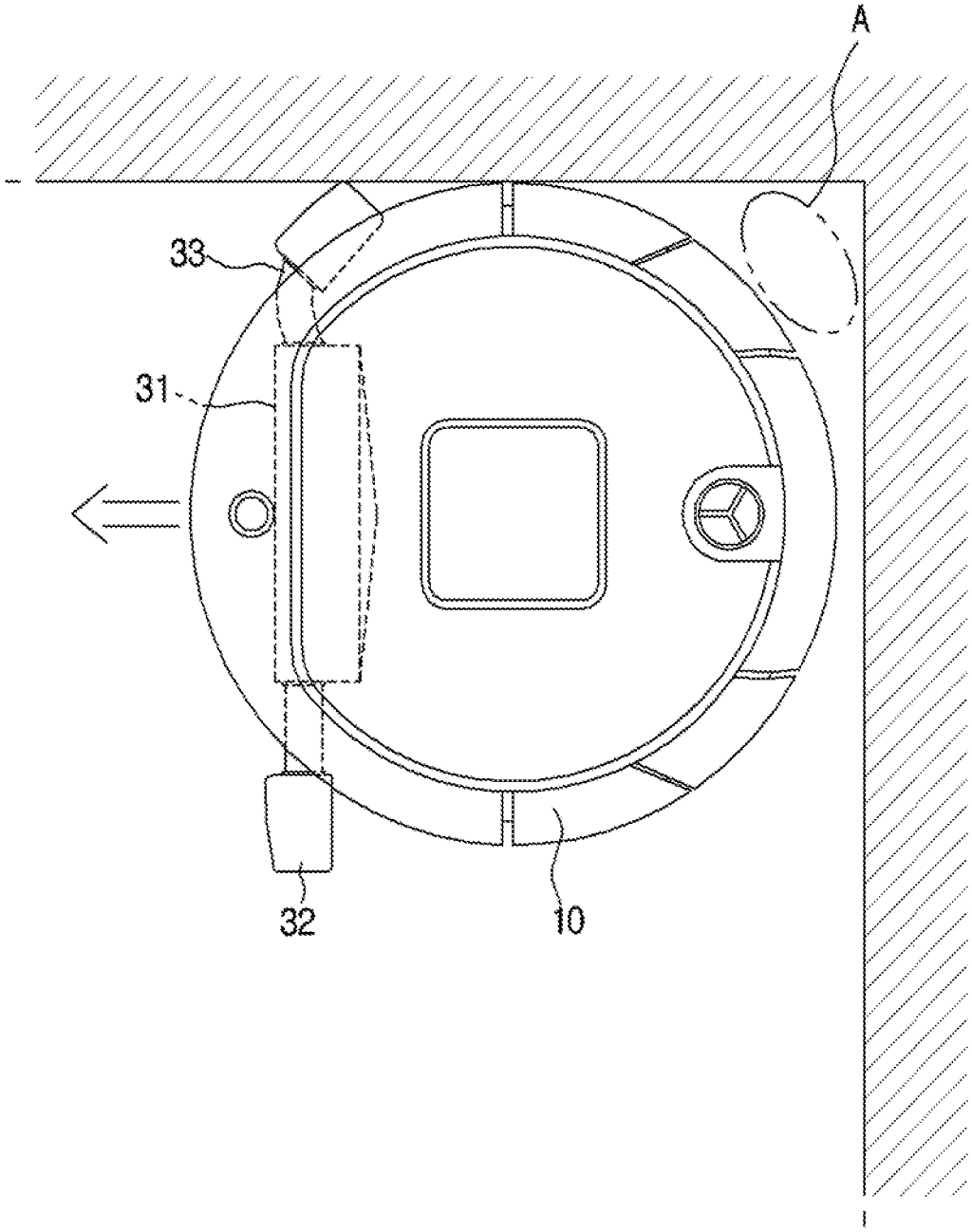

[Fig. 10]
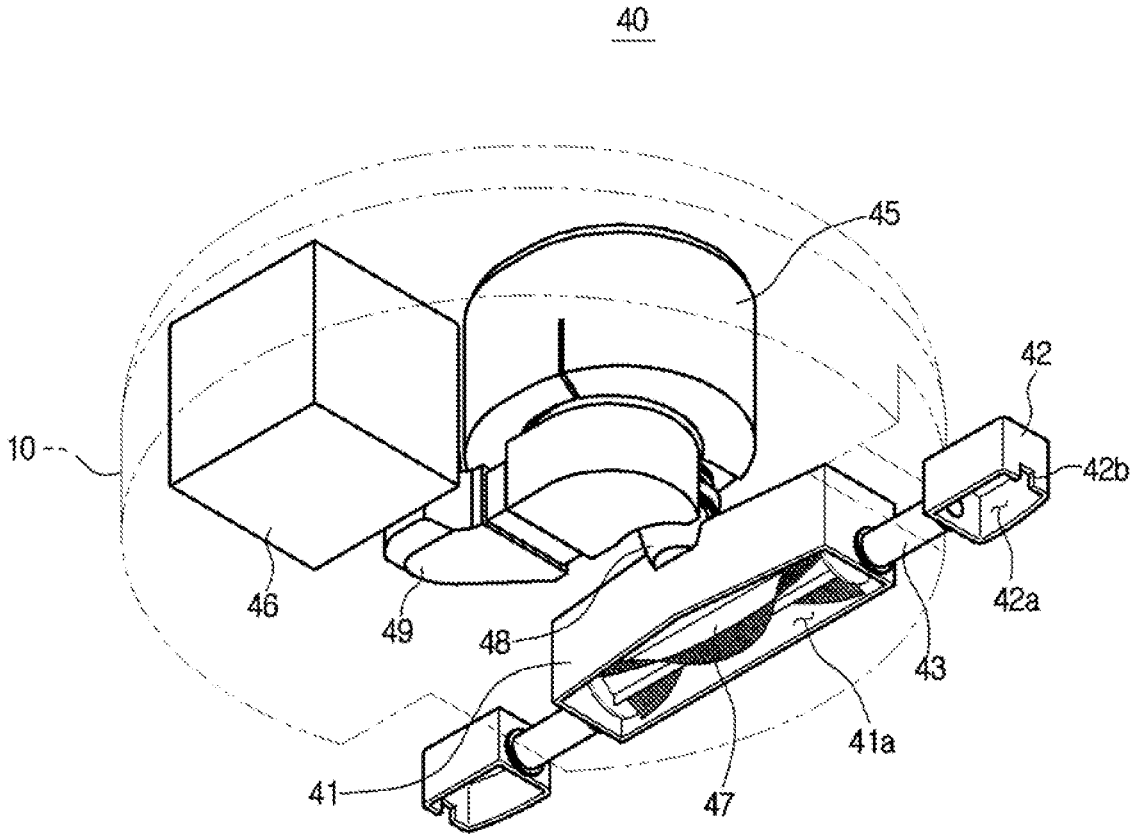
[Fig. 11]
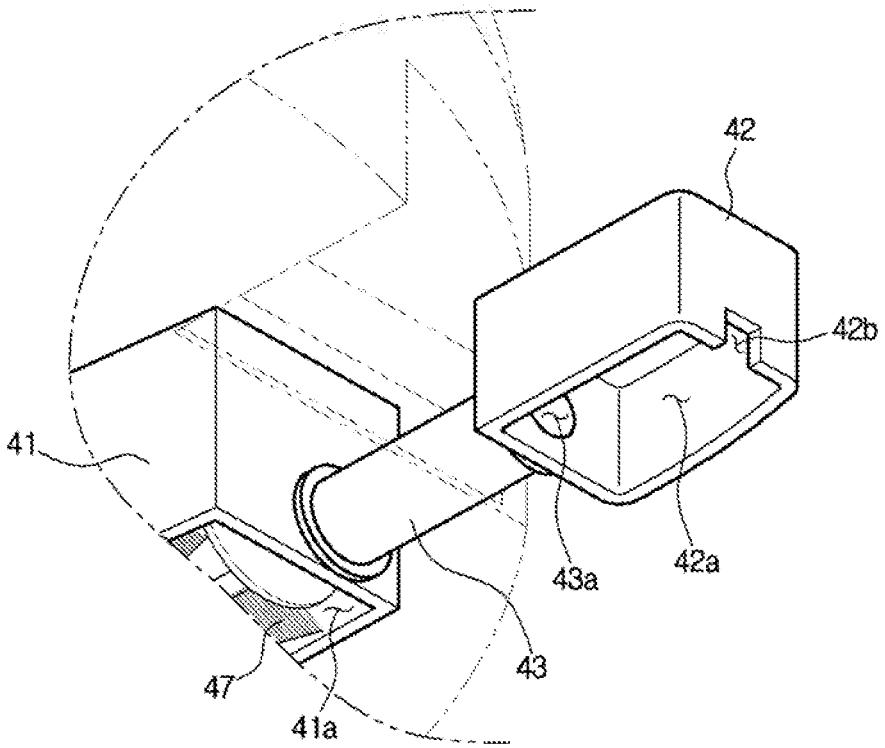

[Fig. 12]
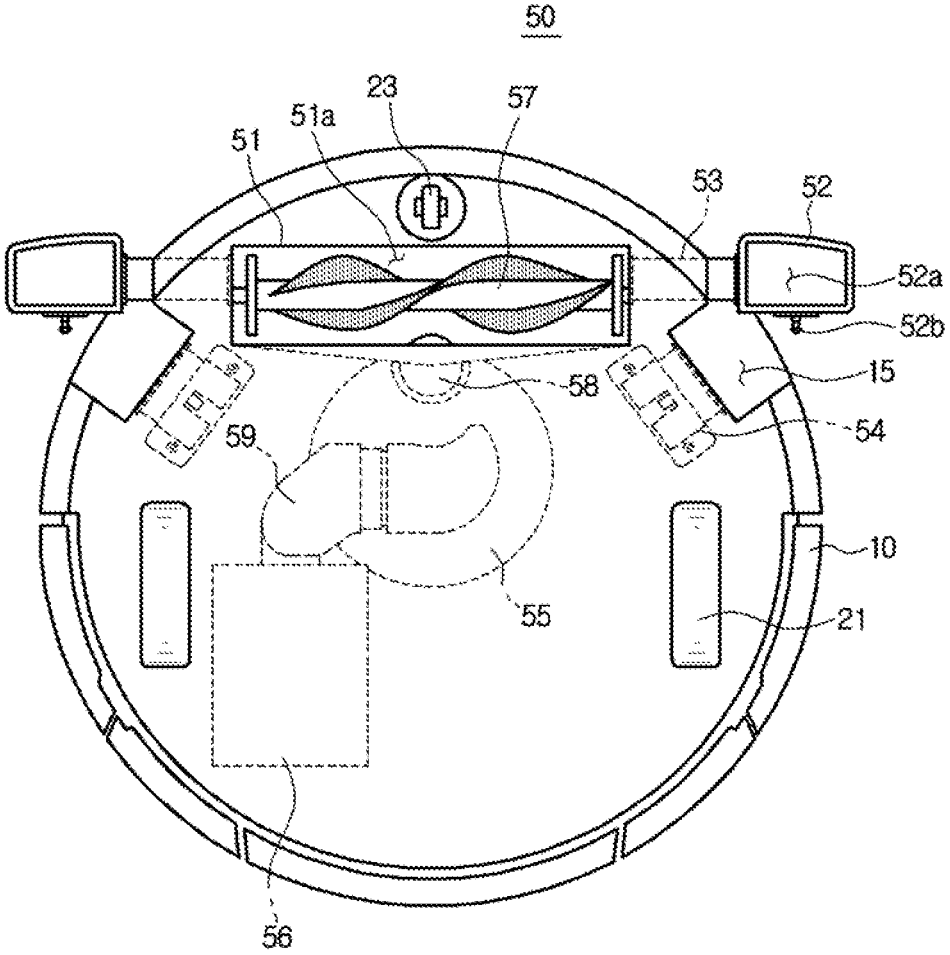

[Fig. 13]
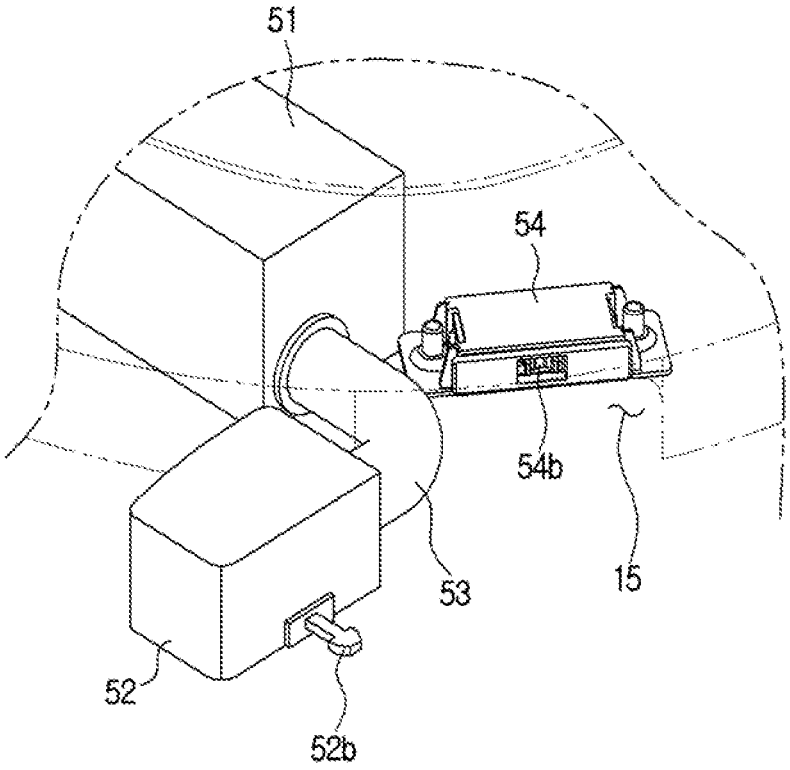

[Fig. 14]
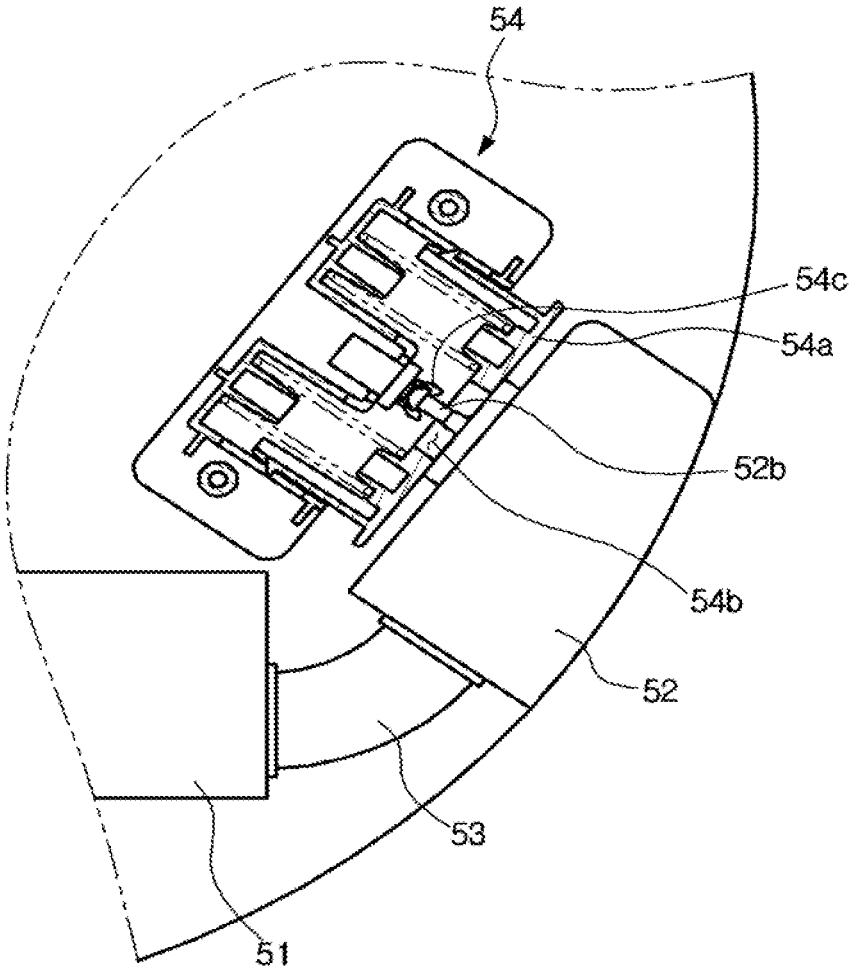

[Fig. 15]
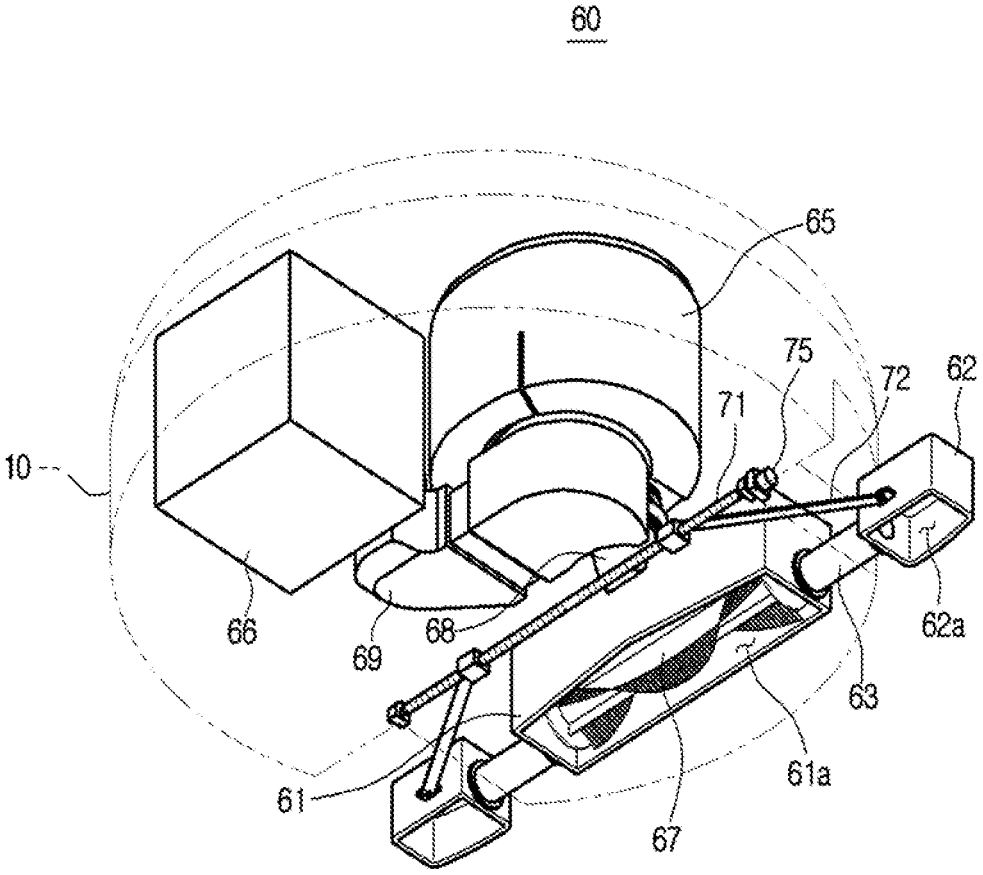

[Fig. 16]
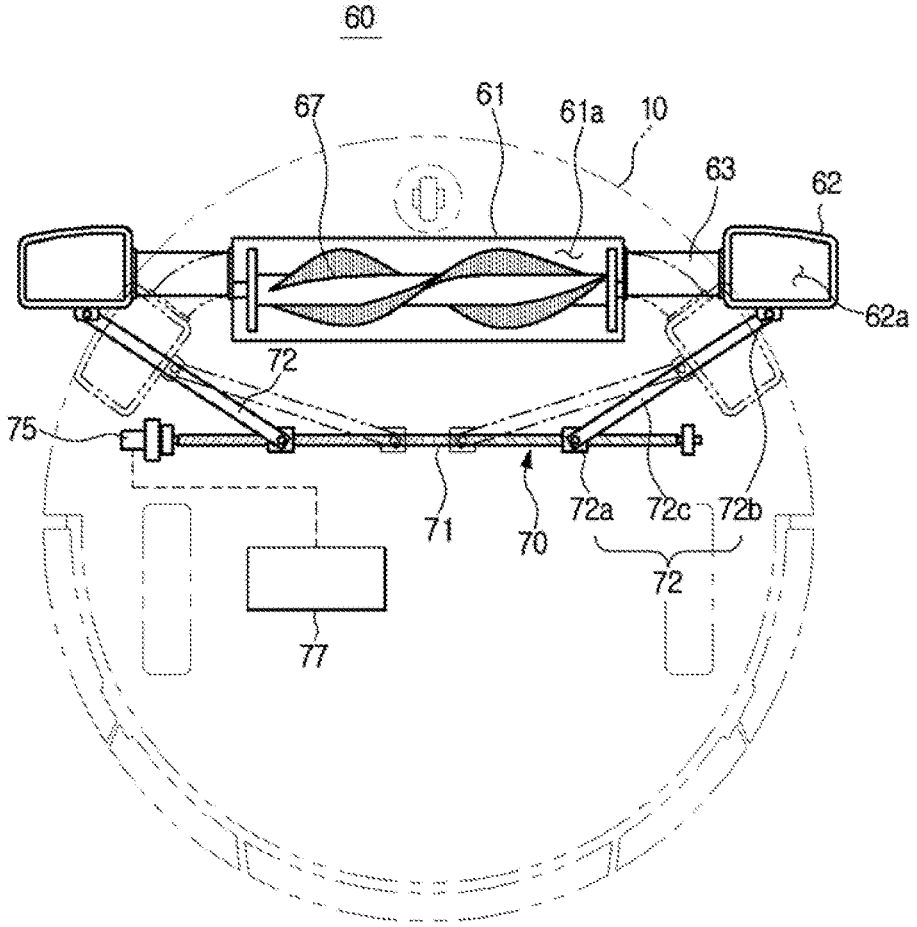
[Fig. 17]
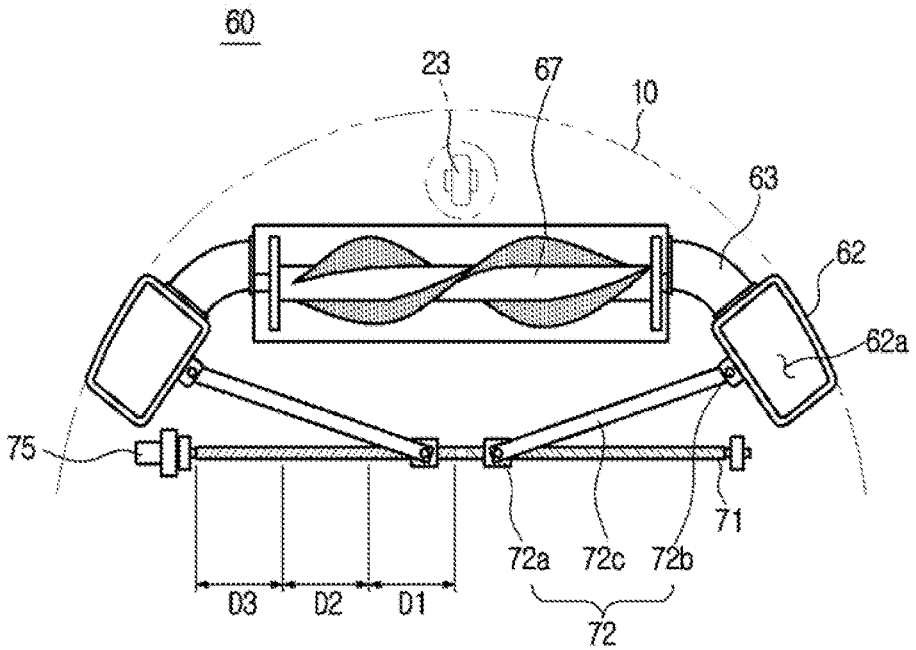

[Fig. 18]
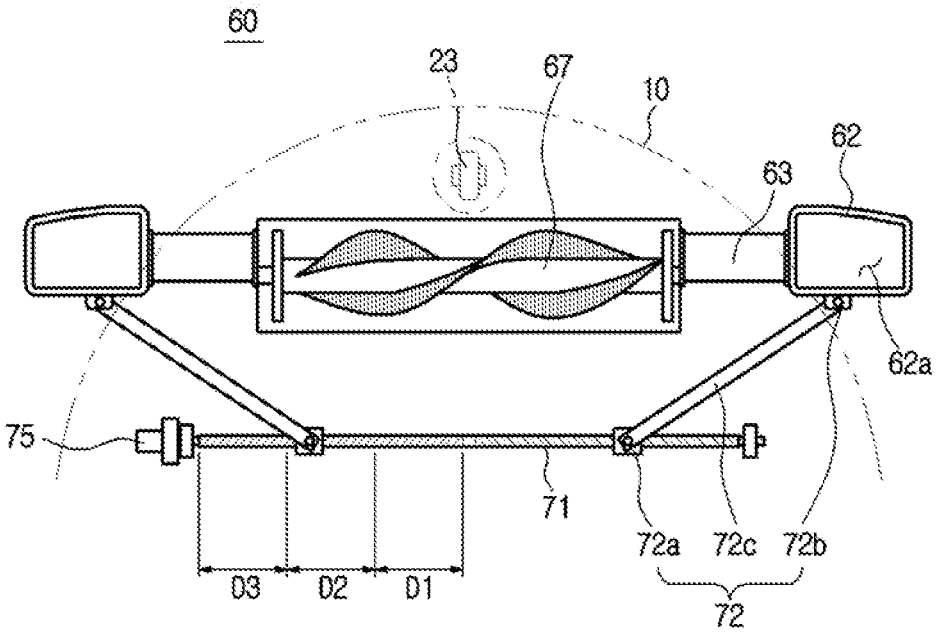
[Fig. 19]
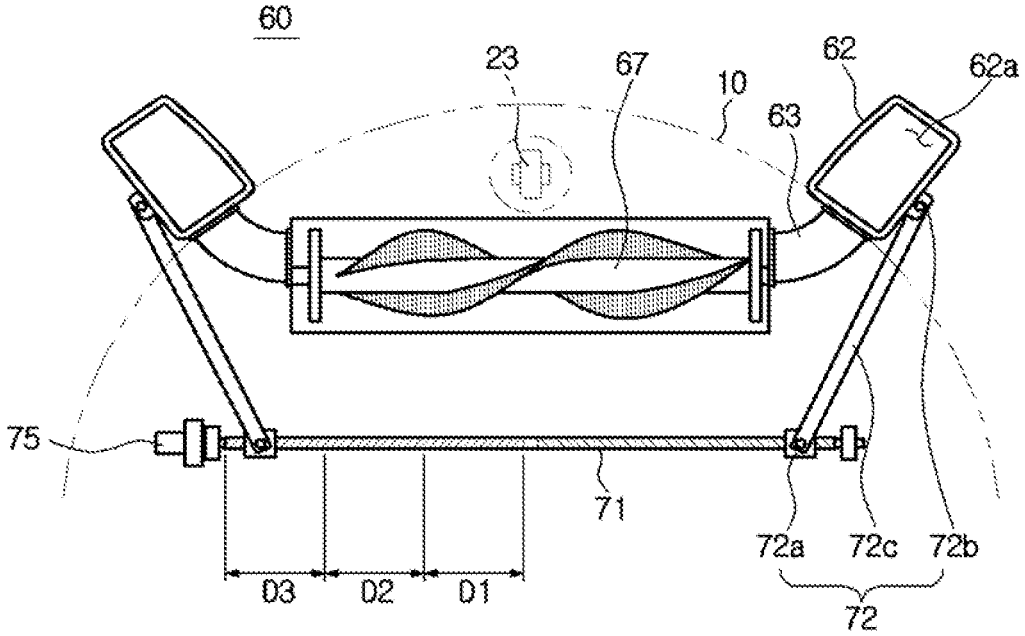

[Fig. 20]
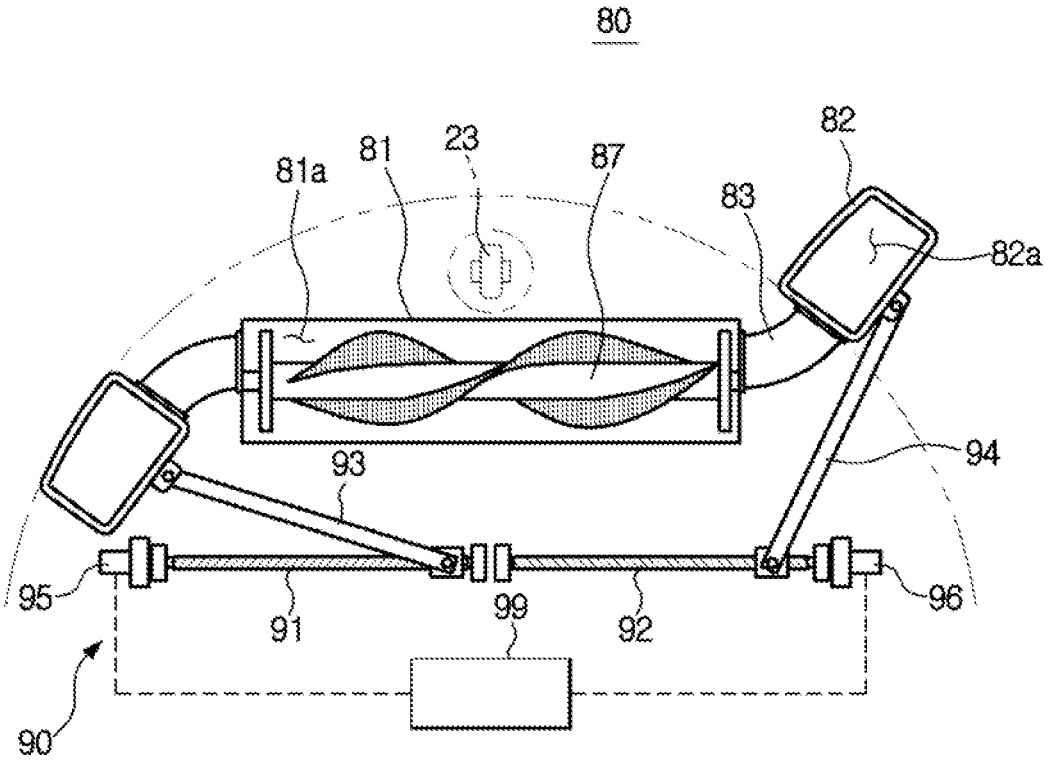

ROBOT CLEANER

CROSS-REFERENCE TO RELATED APPLICATIONS

This application is a continuation application of U.S. application Ser. No. 15/501,668, filed Feb. 3, 2017, which is a U.S. National Stage Application, which claims the benefit under 35 U.S.C. § 371 of PCT International Patent Application No. PCT/KR2015/004237, filed Apr. 28, 2015, which claims the foreign priority benefit under 35 U.S.C. § 119 of Korean Patent Application No. 10-2014-0101733, filed Aug. 7, 2014, the contents of which are incorporated herein by reference.

TECHNICAL FIELD

The present disclosure relates to a robot cleaner in which traveling performance is excellent, a cleaning area is increased, and thus cleaning efficiency is improved.

BACKGROUND ART

A robot cleaner is a device which suctions foreign substances, such as dust, from a floor surface to perform cleaning by itself while traveling through a cleaning area without a user's operation. The robot cleaner detects a distance to an obstacle, such as a piece of furniture, an office supply, or a wall installed in the cleaning area, using a distance sensor and selectively drives a left or right wheel motor of the robot cleaner to change a direction thereof and clean the cleaning area by itself.

Generally, a robot cleaner includes a suction port at a bottom surface thereof and suctions foreign substances on a floor surface through the suction port. A main brush is rotatably provided at a side of the suction port to pick up dust on the floor surface. Accordingly, the robot cleaner can easily suction foreign substances located under a main body thereof, but there is a problem in that the robot cleaner suctions foreign substances located outside the main body.

A robot cleaner is provided in various shapes. Generally, since a robot cleaner having a cylindrical shape easily avoids an external obstacle while traveling, traveling performance of the robot cleaner is excellent. However, a poorly cleaned area, such as a corner of a wall, can occur due to the cylindrical shape. On the other hand, a robot cleaner having a polygonal shape, such as a tetragonal shape, can minimize a poorly cleaned area such as a corner of a wall. However, due to the polygonal shape being obstructed by external obstacles, traveling performance of the polygonal robot cleaner can be lower than that of the cylindrical robot cleaner while traveling.

DISCLOSURE

Technical Problem

The present disclosure is directed to a robot cleaner having an improved structure to improve cleaning efficiency thereof.

The present disclosure is also directed to a robot cleaner having an improved structure to have excellent traveling performance and increase a cleaning area.

Technical Solution

In accordance with an aspect of the present disclosure, a robot cleaner including: a main body; a driving unit configured to move the main body; and a suction device provided in the main body and configured to suction outside foreign substances, and the suction device may include a first suction member having a suction port provided at a bottom surface of the main body and configured to suction the foreign substances, and at least one second suction member formed to move relative to the first suction member and having a suction port configured to suction the foreign substances.

The robot cleaner may further include a connecting pipe configured to connect the first suction member and the second suction member and provided such that a position of the second suction member is variable.

The connecting pipe may be formed of a flexible material.

The suction device may further include a driving motor configured to generate a suction force that is transmitted to the first suction member or the second suction member.

The connecting pipe may include an internal path through which air flows between the first suction member and the second suction member.

At least one opening may be formed at a side surface of the main body, and the second suction member may be provided to be movable inward or outward from the main body through the opening.

The second suction member may be provided to close or open the opening.

The main body may be provided in a cylindrical shape.

The second suction member may include one side surface in a round shape having the same curvature as that of a side surface of the main body.

The second suction member may include a first suction port provided at a bottom surface of the second suction member, and a second suction port provided at at least one side surface of the second suction member.

The second suction port may be provided at a side surface facing a side surface to which the connecting pipe is connected at the second suction member.

The suction device may further include a fixing member provided in the main body and formed such that one side of the second suction member is detachable.

The fixing member may be provided at a position facing the opening in the main body.

The fixing member may be coupled to the second suction member in a state in which the second suction member blocks the opening.

The suction device may further include a moving unit configured to move the second suction member, and the moving unit may include a slide guide provided in the main body, and a slide link configured to connect the slide guide and the second suction member and having one side configured to move along the slide guide and the other side provided to move the second suction member.

The slide link may include a first connector coupled to the slide guide, and a second connector coupled to the second suction member, and when the first connector is positioned at a first position, the second suction member is positioned inside the main body, and when the first connector is positioned at a second position, the second suction member is positioned outside the main body.

The moving unit may further include a driving member configured to drive the slide link, and a controller configured to control the driving member.

A plurality of second suction members each of which is identical to the second suction member may be provided, the same number of slide links, each identical to the slide link, may be provided as the number of the second suction members to be connected to each of the plurality of second suction members, and the controller may control the plurality of slide links such that the plurality of slide links are movable independently.

The same number of driving members, each identical to the driving member, may be provided as the number of the plurality of second suction members, and each of the plurality of driving members may drive a separate slide link.

In accordance with an aspect of the present disclosure, a robot cleaner including: a main body; a driving unit configured to move the main body; and a suction device provided in the main body and configured to suction outside foreign substances, and the suction device may include a first suction member fixedly installed at a bottom surface of the main body, and a second suction member provided beside the first suction member and formed such that a position of the second suction member moves inward or outward from the main body.

The suction device may further include a connecting pipe having one side connected to the first suction member and the other side connected to the second suction member and configured to be flexible so that a position of the second suction member is movable.

The connecting pipe may include an internal path through which air flows between the first suction member and the second suction member.

At least one opening may be formed at a side surface of the main body, and the second suction member may be provided to be movable inward or outward from the main body through the opening.

A suction port configured to suction the foreign substances may be formed at a bottom surface of the first suction member, and the second suction member may include a first suction port provided at a bottom surface of the second suction member, and a second suction port provided at at least one side surface of the second suction member.

The suction device may further include a fixing member provided in the main body and formed such that one side of the second suction member is detachable.

The suction device may further include a moving unit configured to move the second suction member, and the moving unit may include a slide guide provided in the main body, a slide link configured to connect the slide guide and the second suction member and having one side configured to move along the slide guide and the other side provided to move the second suction member, and a driving member configured to drive the slide link.

The slide link may include a first connector coupled to the slide guide and a second connector coupled to the second suction member, and when the first connector is positioned at a first position, the second suction member is positioned inside the main body, and when the first connector is positioned at a second position, the second suction member is positioned outside the main body.

The main body may be provided in a cylindrical shape.

In accordance with an aspect of the present disclosure, a robot cleaner including: a main body provided in a cylindrical shape; a driving unit configured to move the main body; and a suction device provided at the main body and configured to suction outside foreign substances, and the suction device may include a first suction member having a suction port provided at a bottom surface of the main body and configured to suction the foreign substances, at least one second suction member formed to move relative to the first suction member and having a suction port configured to suction the foreign substances, a connecting pipe configured to connect the first suction member and the second suction member and provided such that a position of the second suction member is variable, and a brush member rotatably provided in the suction port of the first suction member and configured to scatter foreign substances located on a cleaning surface.

Advantageous Effects

A robot cleaner according to one embodiment of the present disclosure includes a plurality of suction members on bottom and side surfaces thereof so that cleaning efficiency thereof can be improved.

In addition, the robot cleaner includes a main body having a cylindrical shape to have excellent traveling performance, and includes a suction member provided under the main body and a suction member movable toward the outside of the main body so that a cleanable area can be expanded.

DESCRIPTION OF DRAWINGS

These and/or other aspects of the present disclosure will become apparent and more readily appreciated from the following description of the embodiments, taken in conjunction with the accompanying drawings of which:

FIG. 1 is a perspective view illustrating a robot cleaner according to one embodiment of the present disclosure.

FIG. 2 is a view illustrating a bottom surface of the robot cleaner according to one embodiment of the present disclosure.

FIG. 3 is a perspective view illustrating a suction device of the robot cleaner according to one embodiment of the present disclosure, a robot cleaner according to an embodiment of the present disclosure.

FIG. 4 is a perspective view illustrating an enlarged second suction member of the suction device illustrated in FIG. 3.

FIG. 5 is a view illustrating movement of the second suction member of the suction device illustrated in FIG. 3.

FIGS. 6 to 9 are views illustrating motions of the suction device according to movement of the robot cleaner according to one embodiment of the present disclosure.

FIG. 10 is a perspective view illustrating a first modified example of the suction device of the robot cleaner illustrated in FIG. 3.

FIG. 11 is an enlarged perspective view illustrating the second suction member of the suction device illustrated in FIG. 10.

FIG. 12 is a bottom view illustrating the second modified example of the suction device of the robot cleaner illustrated in FIG. 3.

FIG. 13 is an enlarged view illustrating the second suction member and a fixing member of the suction device illustrated in FIG. 12.

FIG. 14 is an enlarged view illustrating a state in which the second suction member is coupled to the fixing member in the suction device illustrated in FIG. 12.

FIG. 15 is a perspective view illustrating a suction device of the robot cleaner according to another embodiment of the present disclosure.

FIG. 16 is a view illustrating a lower portion of the suction device illustrated in FIG. 15.

FIGS. 17 to 19 are views illustrating movement of the suction device illustrated in FIG. 15.

FIG. 20 is a view illustrating a modified example of the suction device of the robot cleaner illustrated in FIG. 15.

MODES OF THE INVENTION

Hereinafter, a robot cleaner according to one embodiment of the present disclosure will be described in detail with reference to the accompanying drawings.

FIG. 1 is a perspective view illustrating a robot cleaner according to one embodiment of the present disclosure, and FIG. 2 is a view illustrating a bottom surface of the robot cleaner according to one embodiment of the present disclosure.

Referring to FIGS. 1 and 2, a robot cleaner 1 according to one embodiment of the present disclosure may include a main body 10, a driving unit, and a suction device 30.

The main body 10 may form an exterior of the robot cleaner 1. An internal space in which the driving unit and the suction device 30 are installed may be provided in the main body 10.

According to one example, the main body 10 may be provided in a cylindrical shape. When the main body 10 rotates, the cylindrical main body 10 has a constant rotational radius to avoid coming into contact with a surrounding obstacle and easily changes a direction thereof. Furthermore, the cylindrical main body 10 may be prevented from being unable to move by being obstructed by an obstacle while traveling.

Bumpers 11 may be provided at a side surface of the main body 10. The bumpers 11 may be provided to buffer an external impact applied to the robot cleaner 1.

A display 13 may be provided on a top surface of the main body 10. The display 13 may be provided to display various pieces of information such as an operation state of the robot cleaner 1, an amount of dust, a charge amount of a battery, and time.

The robot cleaner 1 may further include a sensor unit (not shown). The sensor unit may perform detection of surrounding terrain, recognition of a position of the robot cleaner 1, detection of an obstacle, or the like. Accordingly, the sensor unit may include a plurality of sensors. The plurality of sensors may be provided at different positions at the main body 10.

The driving unit may be provided to move the robot cleaner 1. The driving unit may include driving wheels 21 provided at a bottom surface of the main body 10. A plurality of driving wheels 21 may be provided. Two driving wheels 21 may be symmetrically disposed at respective left and right edges of a central portion of the bottom surface of the main body 10. The driving wheels 21 may be provided to be movable forward and backward, turning, and the like while the robot cleaner 1 performs cleaning. The driving wheels 21 may be driven by a motor.

The driving unit may further include a castor 23. The castor 23 may be provided in front of the driving wheels 21 at the bottom surface of the main body 10. The castor 23 may be provided to be movable in all directions. The castor 23 may be provided to easily change a direction of the robot cleaner 1.

Hereinafter, the suction device 30 of the robot cleaner according to one embodiment of the present disclosure will be described. The suction device 30 suctions foreign substances together with air to remove foreign substances in a cleaning area.

FIG. 3 is a perspective view illustrating a suction device of the robot cleaner according to one embodiment of the present disclosure, FIG. 4 is a perspective view illustrating an enlarged second suction member of the suction device illustrated in FIG. 3, and FIG. 5 is a view illustrating movement of the second suction member of the suction device illustrated in FIG. 3.

Referring to FIGS. 1 to 5, the suction device 30 according to one embodiment of the present disclosure may include a first suction member 31, second suction members 32, connecting pipes 33, and a driving motor 36.

The first suction member 31 may receive a suction force generated by the driving motor 36 of the main body 10 to suction air including foreign substances outside the main body 10. The first suction member 31 may be provided at one side of the bottom surface of the main body 10. The first suction member 31 may receive the suction force generated by the driving motor 36 through a first path 38 connected to one side of the first suction member 31.

A suction port 31*a*, which is open at the bottom surface of the main body 10, may be formed at the first suction member 31. The suction port 31*a* may be provided as an opening at which a part of the bottom surface of the main body 10 is open. The suction port 31*a* may be provided at a fixed position at the bottom surface of the main body 10. The first suction member 31 may suction air located under the main body 10 through the suction port 31*a*. The first suction member 31 may be provided to suction the air located under the main body 10 while being moved with the main body 10.

The suction device 30 may further include a brush member 37. The brush member 37 may be provided to sweep or scatter foreign substances existing on a cleaning surface. Accordingly, the brush member 37 may allow the suction port 31*a* of the first suction member 31 to easily suction the foreign substances existing on the cleaning surface.

The brush member 37 may be provided at the first suction member 31. The brush member 37 may be provided at a position through which air including foreign substances is introduced into the main body 10. According to one example, the brush member 37 may be provided at the suction port 31*a* of the first suction member 31 through which air is introduced at the bottom surface of the main body 10.

The brush member 37 may be rotatably formed in the suction port 31*a*. The brush member 37 may include a rotating shaft 37*a* and a plurality of brushes 37*b* connected to the rotating shaft 37*a*. In the brush member 37, the plurality of brushes 37*b* may be coupled to the rotating shaft 37*a* to have a spiral shape. Accordingly, the brush member 37 may sweep or scatter the foreign substances existing on the cleaning surface while being rotated in the suction port 31*a*.

The second suction member 32 may be provided to be connected to one side of the first suction member 31 to suction foreign substances with air. The second suction member 32 may be formed to be positioned at a side of the main body 10. The second suction member 32 may be formed to be positioned outside the main body 10 to increase a cleaning area of the robot cleaner 1.

A suction port 32*a* may be formed at a bottom surface of the second suction member 32. The suction port 32*a* may be provided as an opening at which a part of the bottom surface of the second suction member 32 is open. The suction port 32*a* may be provided to change a relative position thereof with respect to the main body 10 according to the second suction member 32.

The second suction member 32 may suction air including foreign substances through the suction port 32*a*. The second suction member 32 may be provided to suction air located outside the main body 10 while being moved with the main body 10. Accordingly, since the second suction member 32 is positioned at an area at which the main body 10 in a cylindrical shape may not suction air located under the main body 10, the cleaning area of the robot cleaner 1 can be expanded.

The second suction member 32 may be provided beside the first suction member 31. The second suction member 32 may be formed to be connected to one side of the suction device 30 and be positioned beside the first suction member 31. According to one example, the second suction member 32 may be formed to be connected to the first suction member 31 through the connecting pipe 33. The second suction member 32 may be connected to a side surface of the first suction member 31.

The second suction member 32 may be positioned outside the main body 10 through an opening 15 formed at a side surface of the main body 10. The second suction member 32 may be formed to suction air including foreign substances located outside the main body 10 while being moved with the main body 10. When connected to the one side of the suction device 30 that is positioned inside the main body 10, the second suction member 32 may be positioned outside the main body 10 through the opening 15. The opening 15 may be provided in a shape corresponding to that of the second suction member 32. Accordingly, the second suction member 32 may expand the cleaning area to the outside of the main body 10 as well as inside the main body 10 of the robot cleaner 1.

The second suction member 32 may be provided so that a position thereof is variable. The second suction member 32 may be connected to the first suction member 31 to move relative to the first suction member 31. The second suction member 32 may be provided to change the position of the second suction member 32 at the outside of the main body 10 by an external force. When the second suction member 32 comes into contact with an obstacle outside the main body 10 while being moved with the main body 10, the position thereof may be moved to prevent the second suction member 32 from being obstructed and prevent movement of the main body 10 from being restricted As illustrated in FIG. 5, the second suction member 32 may be provided to close or open the opening 15 of the main body 10. The second suction member 32 may open or close the opening 15 while being moved inside or outside the main body 10.

The second suction member 32 may have at least one side surface having a round shape having the same curvature as that of the side surface of the cylindrical main body 10. When positioned inside the main body 10, the second suction member 32 may have one side surface positioned to face the outside and having the round shape having the same curvature as that of the side surface of the cylindrical main body 10. Accordingly, the cylindrical shape of the robot cleaner 1 is maintained even when the second suction member 32 is positioned inside the main body 10, and thus esthetics thereof can be improved.

The second suction member 32 may be formed of an elastic material. Since the second suction member 32 moves with the main body 10 outside the main body 10, the second suction member 32 may come into contact with an obstacle. The second suction member 32 may include an elastic material to prevent breakage due to coming into contact with an external obstacle.

A plurality of second suction members 32 may be provided. According to one example, the second suction members 32 may be positioned at respective sides of the first suction member 31. The second suction members 32 may be provided at symmetrical positions around the first suction member 31.

The connecting pipe 33 may connect the one side of the suction device 30 and the second suction member 32. According to one example, the connecting pipe 33 may connect the first suction member 31 and the second suction member 32. One side of the connecting pipe 33 is connected to the first suction member 31, and the other side thereof may be connected to the second suction member 32. The connecting pipe 33 may be coupled to the side surface of the first suction member 31 and laterally extend therefrom.

As illustrated in FIG. 5, the connecting pipe 33 may be provided to allow the position of the second suction member 32 to be changed. The connecting pipe 33 may be provided with a flexible material. Accordingly, the connecting pipe 33 may be bent forward or backward due to an external impact or the like and move the second suction member 32.

An internal path 33*a* may be provided in the connecting pipe 33. The internal path 33*a* of the connecting pipe 33 may act as a path through which air flows between the first suction member 31 and the second suction member 32. The internal path 33*a* may transmit a suction force transmitted from the first path 38, which is connected to the first suction member 31, to the second suction member 32. In addition, the internal path 33*a* may act as a path through which air including foreign substances suctioned by the second suction member 32 flows toward the first suction member 31. The air including foreign substances suctioned through the second suction member 32 may flow through the first suction member 31 and the first path 38 to a dust collecting member 35.

A plurality of connecting pipes 33 may be provided. The number of connecting pipes 33 may be the same as that of the second suction members 32. According to one example, the connecting pipes 33 may be provided at respective sides of the first suction member 31 like the second suction members 32.

The suction device 30 may further include the dust collecting unit 35.

The dust collecting unit 35 may be provided to be connected to the first suction member 31 and the second suction member 32. The dust collecting unit 35 may be provided to accommodate foreign substances included in air introduced through the first suction member 31 and the second suction member 32. The dust collecting unit 35 may include a component which separates foreign substances from air introduced into an inside of the robot cleaner 1.

The dust collecting unit 35 may be provided as a cyclone dust collecting unit. The cyclone dust collecting unit 35 generates a swirling air current to separate foreign substances from air using a centrifugal force. Air from which foreign substances are separated is discharged to the outside, and the foreign substances may be accumulated in the dust collecting unit 35. When a predetermined amount of the foreign substances are accumulated in the dust collecting unit 35, a user separates the dust collecting unit 35 from the robot cleaner 1 and discard the foreign substances therein.

The suction device 30 may further include the first path 38 and a second path 39. The first path 38 connects the first suction member 31 and the dust collecting unit 35. The first path 38 may transmit the suction force generated by the driving motor 36 to the first suction member 31. The first path 38 may act as a path through which air and foreign substances suctioned through the first suction member 31 or the second suction member 32 flow to the dust collecting unit 35.

The second path 39 may connect the dust collecting unit 35 and the driving motor 36. The second path 39 may transmit the suction force generated by the driving motor 36 to the dust collecting unit 35.

The driving motor 36 generates the suction force to suction foreign substances and air. The driving motor 36 may be provided to be connected to the first path 38, the second path 39, and the dust collecting unit 35 and transmit the generated suction force to the first suction member 31 and the second suction member 32.

Driving of the suction device 30 of the robot cleaner 1 according to one embodiment of the present disclosure will be described.

FIGS. 6 to 9 are views illustrating motions of the suction device according to movement of the robot cleaner according to one embodiment of the present disclosure.

The robot cleaner 1 may suction foreign substances while the main body 10 is moved by the driving unit. The robot cleaner 1 may be provided in various shapes, and a cleanable area thereof may be different according to the shapes, positions at which the suction members are installed, and the like.

Generally, a robot cleaner having a cylindrical main body may suction foreign substances located under a main body in an area in which the main body moves. However, foreign substances which are located in a space which may not cleaned by the cylindrical main body 10, such as in a corner illustrated in FIG. 6, may not be suctioned because the suction member does not approach thereto.

Referring to FIGS. 6 to 9, the robot cleaner 1 according to one embodiment of the present disclosure may include the cylindrical main body 10, the first suction member 31 may suction foreign substances through a lower portion of the main body 10, and the second suction member 32 may suction foreign substances through a side of the main body 10. Accordingly, the robot cleaner 1 may suction foreign substances located in an area A which may not cleaned by the cylindrical main body 10. Hereinafter, an area which may not cleaned by the cylindrical main body 10, like the area A illustrated in FIGS. 6 to 9, is defined as a cleaning restriction area A.

Specifically, as illustrated in FIGS. 6 and 7, the robot cleaner 1 may clean while the first suction member 31 and the second suction member 32 suction foreign substances when the robot cleaner 1 moves forward along one sidewall. At this time, the robot cleaner 1 may suction the foreign substances while the second suction member 32 moves with the main body 10 in the cleaning restriction area A located at one side of the cylindrical main body 10.

As illustrated in FIGS. 7 and 8, when an obstacle is located in front of the robot cleaner 1, the main body 10 may turn to one side. At this time, the second suction member 32 may suction foreign substances in the cleaning restriction area A while being turned with the main body 10.

As illustrated in FIGS. 8 and 9, the second suction member 32 may come into contact with an obstacle while being turned with the main body 10. When an external force is applied to the second suction member 32, the connecting pipe 33 is bent and the position of the second suction member 32 may be moved. As illustrated in FIG. 9, the robot cleaner 1 may operate in a state in which a part of the second suction member 32 is positioned inside the main body 10.

As described above, the second suction member 32 positioned outside the main body 10 of the robot cleaner 1 according to one embodiment of the present disclosure may suction the foreign substances in the cleaning restriction area A. Accordingly, there is an effect in that a cleanable area is expanded. Particularly, since the cleaning restriction area A, which cannot be cleaned when the robot cleaner 1 includes the cylindrical main body 10, is decreased, cleaning efficiency can be improved.

In addition, since the position of the second suction member 32 positioned outside the main body 10 is provided to be variable, a problem in that an external obstacle obstructs the second suction member 32 can be prevented. Accordingly, traveling performance of the robot cleaner 1 can be improved.

Hereinafter, a first modified example of the suction device of the robot cleaner according to one embodiment of the present disclosure will be described.

FIG. 10 is a perspective view illustrating a first modified example of the suction device of the robot cleaner illustrated in FIG. 3, and FIG. 11 is an enlarged perspective view illustrating the second suction member of the suction device illustrated in FIG. 10.

Referring to FIGS. 10 and 11, a suction device 40 may include a first suction member 41, second suction members 42, connecting pipes 43, a dust collecting unit 45, a driving motor 46, a brush member 47, a first path 48, and a second path 49.

The suction device 40 may be provided such that the second suction member 42 is different and the remaining components may be the same as or similar to those in the suction device 30 illustrated in FIG. 3. Hereinafter, differences with the suction device 30 illustrated in FIG. 3 will be mainly described, and the same or similar components will not be described.

The second suction member 42 may be provided to be connected to one side of the first suction member 41 to suction foreign substances and air. The second suction member 42 may be formed to be positioned beside the main body 10. The second suction member 42 is positioned outside the main body 10, and thus the cleaning area of the robot cleaner 1 can be increased.

According to one example, the second suction member 42 may include a first suction port 42*a* and a second suction port 42*b*.

The first suction port 42*a* may be formed at a bottom surface of the second suction member 42. The first suction port 42*a* may be formed by a part of the bottom surface of the second suction member 32 being open. The first suction port 42*a* may be provided to receive a suction force from the connecting pipe 43 to suction foreign substances.

The second suction port 42*b* may be provided at least one side surface of the second suction member 42. According to one example, the second suction port 42*b* may be provided at a side surface opposite a side surface coupled to the connecting pipe 43. The second suction port 42*b* may be formed to suction foreign substances located beside the second suction member 42 so that the cleaning area of the robot cleaner 1 can be increased. Alternatively, the second suction port 42*b* may also be provided at a different side surface of the second suction member 42. In addition, a plurality of second suction ports 42*b* may also be provided at each of different side surfaces of the second suction member 42.

The second suction member 42 may suction air including foreign substances through the first suction port 42*a* and the second suction port 42*b*. The second suction member 42 may be provided to suction air located outside the main body 10 while being moved with the main body 10. Accordingly, since the second suction member 42 is positioned at an area in which air may not be suctioned through a lower portion of the cylindrical main body 10, the cleaning area of the robot cleaner 1 can be expanded.

The second suction member 42 may be provided beside the first suction member 41. The second suction member 42 may be connected to one side of the suction device 40 and be positioned beside the first suction member 41. According to one example, the second suction member 42 may be formed to be connected to the first suction member 41 through the connecting pipe 43. The second suction member 42 may be connected to a side surface of the first suction member 41.

The second suction member 42 may be provided to be positioned outside the main body 10 through the opening 15 formed at a side surface of the main body 10. The second suction member 42 may be formed to suction air including foreign substances located outside the main body 10 while being moved with the main body 10. The second suction member 42 is connected to one side of the suction device 40 positioned inside the main body 10, and may be positioned outside the main body 10 through the opening 15. The opening 15 may be provided in a shape corresponding to that of the second suction member 42. Accordingly, the second suction member 42 may expand the cleaning area to the outside of the main body 10 as well as the inside of the main body 10 of the robot cleaner 1.

The second suction member 42 may be provided so that a position thereof is variable. The second suction member 42 may be connected to the first suction member 41 to move relative to the first suction member 41. The second suction member 42 may be provided to change the position of the second suction member 42 at the outside of the main body 10 by an external force. When the second suction member 42 comes into contact with an obstacle outside the main body 10 while being moved with the main body 10, the position thereof may be moved to prevent the second suction member 42 from being obstructed and prevent movement of the main body 10 from being restricted.

The second suction member 42 may have at least one side surface having a round shape having the same curvature as that of the side surface of the cylindrical main body 10. When positioned inside the main body 10, the second suction member 42 may have one side surface positioned to face the outside and having the round shape having the same curvature as that of the side surface of the cylindrical main body 10. Accordingly, the cylindrical shape of the robot cleaner 1 is maintained even when the second suction member 42 is positioned inside the main body 10, and thus esthetics thereof can be improved.

The second suction member 42 may be formed of an elastic material. Since the second suction member 42 moves outside the main body 10 with the main body 10, the second suction member 42 may come into contact with an obstacle. The second suction member 42 may include an elastic material to prevent breakage due to coming into contact with an external obstacle.

A plurality of second suction members 42 may be provided. According to one example, the second suction members 42 may be provided to be positioned at respective sides of the first suction member 41. The second suction members 42 may be provided at symmetrical positions around the first suction member 41.

Hereinafter, a second modified example of a suction device 51 of the robot cleaner according to one embodiment of the present disclosure will be described.

FIG. 12 is a bottom view illustrating the second modified example of the suction device of the robot cleaner illustrated in FIG. 3, FIG. 13 is an enlarged view illustrating the second suction member and a fixing member of the suction device illustrated in FIG. 12, and FIG. 14 is an enlarged view illustrating a state in which the second suction member is coupled to the fixing member in the suction device illustrated in FIG. 12.

Referring to FIGS. 12 to 14, a suction device 50 may include a first suction member 51, second suction members 52, connecting pipes 53, fixing members 54, a dust collecting unit 55, a driving motor 56, a brush member 57, a first path 58, and a second path 59.

The suction device 50 may be provided such that the fixing member 54 is further included, the second suction member 52 is different, and the other components may be the same as or similar to those in the suction device 30 illustrated in FIG. 3. Hereinafter, differences with the suction device 30 illustrated in FIG. 3 will be mainly described, and the same or similar components will not be described.

The fixing member 54 may be provided so that the second suction member 52 may be coupled thereto. The fixing member 54 may be positioned inside the main body 10. The fixing member 54 may be provided inside the main body 10 at a position facing the opening 15. Accordingly, the fixing member 54 may be provided to be coupled to the second suction member 52 in a state in which the second suction member 52 blocks the opening 15 of the main body 10.

According to one embodiment, the fixing member 54 may be provided as a latch device.

The fixing member 54 may include a contact portion 54*a*, a coupling hole 54*b*, and a locking portion 54*c*. The contact portion 54*a* may be provided in the fixing member 54 at a surface facing the second suction member 52. The contact portion 54*a* may be provided to be movable inward from the fixing member 54. The contact portion 54*a* may be connected to a restoring member (not shown) provided inside the fixing member 54. The restoring member may be provided to provide the contact portion 54*a* at a predetermined position.

The coupling hole 54*b* may be positioned at one side of the contact portion 54*a*. The coupling hole 54*b* may act as a path through which the second suction member 52 passes to be coupled to the locking portion 54*c*.

The locking portion 54*c* may be provided inside the fixing member 54. The locking portion 54*c* may be provided at a fixed position inside the fixing member 54. The locking portion 54*c* may be provided to be coupled to the second suction member 52 in a state in which the contact portion 54*a* moves a predetermined distance inward.

A protrusion 52*b* may be formed at one side of the second suction member 52. The protrusion 52*b* may be provided at a surface facing the fixing member 54 in a state in which the second suction member 52 is positioned inside the main body 10. The protrusion 52*b* may be provided to be coupled to the locking portion 54*c*.

The second suction member 52 may be coupled to the fixing member 54 and positioned inside the main body 10. The second suction member 52 may block the opening 15 while being coupled to the fixing member 54. Accordingly, a user may couple or separate the second suction member 52 to or from the fixing member 54 when selecting a cleaning mode of the robot cleaner 1.

The second suction member 52 has the same structure as that of the second suction member 32 illustrated in FIG. 3 except for the protrusion 52*b*. Accordingly, the remaining components of the second suction member 52 will not be described.

Hereinafter, a suction device 60 of a robot cleaner according to another embodiment of the present disclosure will be described.

FIG. 15 is a perspective view illustrating a suction device of the robot cleaner according to another embodiment of the present disclosure, and FIG. 16 is a view illustrating a lower portion of the suction device illustrated in FIG. 15.

Referring to FIGS. 15 and 16, the suction device 60 may include a first suction member 61, second suction members 62, connecting pipes 63, a dust collecting unit 65, a driving motor 66, a brush member 67, a first path 68, a second path 69, and a moving unit 70.

The suction device 60 has a difference in that a configuration thereof further includes the moving unit 70 when compared with the suction device 30 illustrated in FIG. 3. However, since the remaining components of the suction device 60 except the moving unit 70 are the same as or similar to the components of the suction device 30 illustrated in FIG. 3, descriptions thereof will be omitted. Hereinafter, differences with the suction device 30 illustrated in FIG. 3 will be mainly described.

The moving unit 70 may move a position of the second suction member 62. The moving unit 70 may include a slide guide 71 and slide links 72.

The slide guide 71 may be provided at one side in a main body 10. According to one embodiment, the slide guide 71 may be provided to be parallel with the first suction member 61 in the main body 10. The slide guide 71 may be provided so that the slide links 72 may move along the slide guide 71.

The slide link 72 may move the position of the second suction member 62. The slide link 72 may be provided to connect the second suction member 62 and the slide guide 71. The slide link 72 may move the position of the second suction member 62 while being moved along the slide guide 71.

The slide link 72 may include a first connector 72*a* connected to the slide guide 71, a second connector 72*b* connected to the second suction member 62, and a third connector 72*c* extending from the first connector 72*a* to the second connector 72*b*.

The first connector 72*a* may be formed to move along the slide guide 71. The first connector 72*a* may move the second suction member 62 to a specific position according to a position of the first connector 72*a* on the slide guide 71. The first connector 72*a* may be formed to rotate the third connector 72*c* by being hinge-coupled to the third connector 72*c*.

The second connector 72*b* may be fixedly coupled to the second suction member 62. Accordingly, the second connector 72*b* may be formed to move the second suction member 62 to correspond to movements of the first connector 72*a* and the third connector 72*c*. The second connector 72*b* may be formed to rotate the third connector 72*c* by being hinge-coupled to the third connector 72*c*.

A plurality of slide links identical to the slide link 72 may be provided. The number of the slide links 72 may be the same as the number of second suction members 62. Accordingly, each of the slide links 72 may move the second suction member 62 connected thereto.

The moving unit 70 may further include a driving member 75. The driving member 75 may generate power to move the first connector 72*a*.

The moving unit 70 may further include a controller 77. The controller 77 may control the driving member 75 to adjust movement of the slide link 72. The controller 77 may control the slide link 72 to be moved in a preset cleaning mode according to an operation of a user. In addition, the controller 77 may control each of the plurality of slide links 72 so that each of the plurality of second suction members 62 is positioned at a different position.

Hereinafter, an operation of the suction device 60 will be described.

FIGS. 17 to 19 are views illustrating movement of the suction device illustrated in FIG. 15.

Referring to FIGS. 17 to 19, the suction device 60 is provided to move the second suction member 62 by the moving unit 70. Specifically, a position of the second suction member 62 may be moved according to a position of the first connector 72*a* of the slide link 72 in the suction device 60.

As illustrated in FIG. 17, when the first connector 72*a* is positioned in a first area D1 of the slide guide 71, the second suction member 62 may be positioned inside the main body 10.

As illustrated in FIG. 18, when the first connector 72*a* is positioned in a second area D2 of the slide guide 71, the second suction member 62 may be positioned outside the main body 10. When the first connector 72*a* is positioned in the second area D2, the second suction member 62 may be positioned beside the first suction member 61.

As illustrated in FIG. 19, when the first connector 72*a* is positioned in a third area D3 of the slide guide 71, the second suction member 62 may be positioned outside the main body 10 in front of the first suction member 61.

As described above, the position of the second suction member 62 may be moved while the first connector 72*a* of the slide link 72 moves between the first area D1 and the third area D3 on the slide guide 71. Accordingly, the suction device 60 may allow the second suction member 62 to be positioned at a specific position unlike the suction device 30 illustrated in FIG. 3.

FIG. 20 is a view illustrating a modified example of the suction device of the robot cleaner illustrated in FIG. 15.

Referring to FIG. 20, the suction device 80 may be provided such that there is a difference in a configuration of a moving unit 90 and the remaining components may be the same as those in the suction device 60 illustrated in FIG. 15. Hereinafter, differences with the suction device 60 illustrated in FIG. 15 will be mainly described.

The moving unit 90 may include slide guides 91 and 92, slide links 93 and 94, driving members 95 and 96, and a controller 99.

In the moving unit 90, a plurality of slide guides 91 and 92, a plurality of slide links 93 and 94, and a plurality of driving members 95 and 96 may be provided. The numbers of slide guides 91 and 92, the number of slide links 93 and 94, and the number of driving members 95 and 96 may each be the same as the number of second suction members 82. Accordingly, each of the second suction members 82 may be provide to be connected to the slide guide 91, the slide link 93, and the driving member 95.

The slide guides 91 and 92 may include a first slide guide 91 and a second slide guide 92. The first slide guide 91 may be provided to be connected to the second suction member 82 coupled to one side of the first suction member 81, and the second slide guide 92 may be provided to be connected to the second suction member 82 coupled to the other side of the first suction member 81.

The slide links 93 and 94 may include a first slide link 93 and a second slide link 94. The first slide link 93 may be formed to be connected to the first slide guide 91, and the second slide link 94 may be formed to be connected to the second slide guide 92. Accordingly, each of the first slide link 93 and the second slide link 94 may be connected to a different second suction member 82.

The driving members 95 and 96 may include a first driving member 95 and the second driving member 96. The first driving member 95 may be formed to transmit power to the first slide link 93, and the second driving member 96 may be formed to transmit power to the second slide link 94. Unlike the suction device 60 illustrated in FIG. 15, the plurality of the driving members 95 and 96 may respectively transmit power to different slide links 93 and 94 to efficiently drive the moving unit 90.

The controller 99 may be connected to the driving members 95 and 96 to control the driving members 95 and 96. As illustrated in FIG. 20, the controller 99 may control each of the driving members 95 and 96 to independently move each of the plurality of second suction members 82.

In the above description of the present disclosure, although specific forms are mainly described, it should be understood that various modifications and changes may be made by those skilled in the art, and such modifications and changes may fall within the scope of the appended claims.

The invention claimed is:

1. A robot cleaner comprising:

a main body having an opening in a side surface of the main body;

a first suction member in the main body and having a suction port at a bottom surface of the main body to suction foreign substances that are outside of the main body to be collected by the robot cleaner;

a second suction member having a suction port to suction foreign substances that are outside of the main body; and a flexible connecting pipe connected to the second suction member so that the foreign substances suctioned by the suction port of the second suction member pass through the connecting pipe to be collected by the robot cleaner, and configured so that flexibility of the connecting pipe provides for the second suction member to be movable forward and backward along an arcuate path to thereby be moveable inward and outward from the main body through the opening and to be movable relative to the first suction member.

2. The robot cleaner of claim 1, further comprising:

a locking portion; and a protrusion which is coupleable to the locking portion to hold a side of the second suction member and thereby hold the second suction member at a position where at least a portion of the second suction member is within the main body, and which is decoupleable from the locking portion to release the side of the second suction member and thereby release the second suction member from the position.

3. The robot cleaner of claim 2, wherein the locking portion and the protrusion are configured so that the at least a portion of the second suction member passes through the opening in the main body to be held at the position.

4. The robot cleaner of claim 2, wherein, when the second suction member is held at the position, the second suction member blocks the opening.

5. The robot cleaner of claim 1, wherein the connecting pipe has a first end connected to the first suction member and a second end connected to the second suction member, so that the foreign substances suctioned by the suction port of the second suction member pass through then connecting pipe and then through the first suction member to be collected by the robot cleaner.

6. A robot cleaner comprising:

a main body having an opening in a side surface of the main body;

a first suction member in the main body and having a suction port at a bottom surface of the main body to suction foreign substances that are outside of the main body to be collected by the robot cleaner;

a flexible connecting pipe having first and second ends, with the first end connected to the first suction member;

a second suction member connected to the second end of the connecting pipe and having a suction port to suction foreign substances that are outside of the main body so that the foreign substances suctioned by the suction port of the second suction member pass through the connecting pipe and then through the first suction member to be collected by the robot cleaner, wherein flexibility of the connecting pipe provides for the second suction member to be movable forward and backward along an arcuate path to thereby be moveable inward and outward from the main body through the opening and to be movable relative to the first suction member.

7. The robot cleaner of claim 6, further comprising:

a locking portion; and a protrusion which is coupleable to the locking portion to hold a side of the second suction member and thereby hold the second suction member at a position where at least a portion of the second suction member is within the main body, and which is decoupleable from the locking portion to release the side of the second suction member and thereby release the second suction member from the position.

8. The robot cleaner of claim 7, wherein the locking portion and the protrusion are configured so that the at least a portion of the second suction member passes through the opening in the main body to be held at the position.

9. The robot cleaner of claim 7, wherein, when the second suction member is held at the position, the second suction member blocks the opening.

* * * * *